US009207645B2

(12) United States Patent
Karapatis et al.

(10) Patent No.: US 9,207,645 B2
(45) Date of Patent: Dec. 8, 2015

(54) ACOUSTIC RADIATING MEMBRANE FOR A MUSICAL WATCH

(71) Applicant: Montres Breguet SA, L'Abbaye (CH)

(72) Inventors: Polychronis Nakis Karapatis, Premier (CH); Younes Kadmiri, Morre (FR); Davide Sarchi, Renens (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/556,370

(22) Filed: Dec. 1, 2014

(65) Prior Publication Data

US 2015/0160618 A1 Jun. 11, 2015

(30) Foreign Application Priority Data

Dec. 9, 2013 (EP) ..... 13196238

(51) Int. Cl.

| | |
|---|---|
| ***G04B 21/08*** | (2006.01) |
| ***G04B 23/02*** | (2006.01) |
| ***G04B 37/00*** | (2006.01) |
| ***G10K 1/07*** | (2006.01) |

(52) U.S. Cl.

CPC ..... *G04B 37/0075* (2013.01); *G04B 21/08* (2013.01); *G04B 23/028* (2013.01); *G10K 1/07* (2013.01)

(58) Field of Classification Search

CPC ..... G04B 21/02; G04B 21/08; G04B 23/028; G04B 37/0075; G10K 1/07

USPC ..... 368/75, 244, 255, 269, 272–274

See application file for complete search history.

(56) References Cited

U.S. PATENT DOCUMENTS

| | | | | |
|---|---|---|---|---|
| 3,042,913 | A | 7/1962 | Zavattaro | |
| 3,906,713 | A | 9/1975 | Suda et al. | |
| 4,918,674 | A | 4/1990 | Shimozono et al. | |
| 5,416,751 | A | 5/1995 | Imahori et al. | |
| 5,726,626 | A | 3/1998 | Jabbour | |
| 2011/0228647 | A1 * | 9/2011 | Karapatis et al. | 368/244 |
| 2012/0140602 | A1 | 6/2012 | Favre et al. | |
| 2012/0140603 | A1 * | 6/2012 | Sarchi et al. | 368/272 |
| 2012/0243389 | A1 * | 9/2012 | Sciascia et al. | 368/315 |

FOREIGN PATENT DOCUMENTS

| | | |
|---|---|---|
| CH | 311 296 | 11/1955 |
| CH | 704 673 A2 | 9/2012 |

(Continued)

OTHER PUBLICATIONS

Search Report issued Jan. 26, 2015 in European Patent Application No. EP 13 19 6238.

(Continued)

*Primary Examiner* — Vit W Miska

(74) *Attorney, Agent, or Firm* — Oblon, McClelland, Maier & Neustadt, L.L.P.

(57) ABSTRACT

The acoustic radiating membrane is provided to equip a musical watch or a striking watch. The dome-shaped membrane comprises an active central portion, a lateral wall and a peripheral edge portion for holding the membrane in a watch case. The central portion includes a central base connected by connecting elements to a peripheral ring, the central base, the connecting elements and the peripheral ring being of dimensions determined to amplify a first vibration mode of one or more notes in a frequency range from 500 Hz to 3.5 kHz.

20 Claims, 3 Drawing Sheets

(56) References Cited

FOREIGN PATENT DOCUMENTS

| | | | |
|---|---|---|---|
| EP | 0 598 556 | A1 | 5/1994 |
| EP | 0 741 344 | A1 | 11/1996 |
| EP | 2 461 219 | A1 | 6/2012 |
| EP | 2 461 220 | A1 | 6/2012 |
| GB | 2 183 870 | A | 6/1987 |

OTHER PUBLICATIONS

European Search Report issued Jul. 22, 2014 in European Application 13196238, filed on Dec. 9, 2013.

* cited by examiner

ACOUSTIC RADIATING MEMBRANE FOR A MUSICAL WATCH

This application claims priority from European Patent Application No. 13196238.3 filed Dec. 9, 2013, the entire disclosure of which is hereby incorporated herein by reference.

FIELD OF THE INVENTION

The invention concerns an acoustic radiating membrane for a musical watch, or a striking watch.

BACKGROUND OF THE INVENTION

In the field of watch making, a striking mechanism may be added to a watch movement in order to generate a sound or piece of music. The gong of the striking watch or the vibration plate of the musical watch are generally arranged inside the watch case. Thus, the vibrations of the gong or the vibration plate strips are transmitted to the various external parts of the watch. These external parts are, for example, the middle part, the bezel, the crystal and the back cover of the watch case. These large external parts start to radiate sound into the air under the effect of the transmitted vibrations. When a sound is produced either by a gong struck by a hammer, or by one or more vibrating strips of the vibration plate, these external parts are capable of radiating the produced sound into the air.

Usually, in a striking or musical watch of this type, acoustic efficiency, based on the complex vibro-acoustic transduction of the external parts, is low. In order to improve and increase the acoustic level perceived by the user of the striking or musical watch, the material, geometry and boundary conditions of the external parts must be taken into account. The configurations of these external parts are also dependent upon the aesthetic appearance of the watch and operating stresses, which may limit adaptation possibilities.

To further improve the vibro-acoustic efficiency of the striking mechanism, a membrane can be arranged inside the watch case. The membrane must be dimensioned so that all the notes generated by the vibration of one of more gongs, or of the vibration plate strips are efficiently radiated. It is therefore important that the frequency of these notes is close to the natural modes of the membrane in order to allow it to enter into resonance.

It is noted in this regard that a high modal density over a limited frequency bandwidth, for example between 500 Hz and 3.5 kHz. is hard to obtain using standard uniform membranes, since this characteristic is only compatible with uniform membranes of very low stiffness or of very high mass. The two characteristics are not advantageous, since reducing the frequency of the first resonant mode to around 1,000 Hz in this manner also reduces the frequency of the excited modes, whose acoustic performance is very limited, to below 4,000 Hz. The mechanical energy is therefore dissipated in vibration modes of the membrane having poor acoustic efficiency. The radiation efficiency, which is logically defined as the ratio between the radiated acoustic wave energy divided by the total energy transferred to the membrane, is therefore reduced over almost the entire frequency range of interest. It is therefore hard to obtain a resonance on every note generated by the striking mechanism, which constitutes a drawback of state of the art membranes.

EP Patent Application No. 2 461 219 A1, which discloses an acoustic radiating membrane for a musical or striking watch, may be cited in this regard. This acoustic membrane has a general dome shape with its peripheral edge sandwiched between part of the middle part and the back cover of the watch case. This membrane is designed with one or two asymmetrically shaped areas formed in the material of the membrane. The two areas excavated in the general thickness of the membrane are of different dimensions. These two areas form ellipses, which are offset from each other relative to the centre of the membrane and partly superposed. With these ellipses in the membrane, it is possible to have twice the number of modes of vibration for each ellipse in comparison with a circular shape. However, this does make it possible to increase the bandwidth of vibration modes of the membrane to obtain a vibratory response amplified over a larger frequency bandwidth, which constitutes a drawback.

SUMMARY OF THE INVENTION

It is therefore an object of the invention to overcome the drawbacks of the aforementioned state of the art, by providing an acoustic radiating membrane for a musical watch or striking watch, created to obtain an amplified response of the membrane over a broader frequency bandwidth.

The invention therefore concerns an acoustic radiating membrane for a musical watch or a striking watch, the membrane including a central active portion and an edge portion for retaining the membrane in a watch case, wherein the central portion includes a central base connected by connecting elements to a peripheral ring, the central base, the connecting elements and the peripheral ring being of determined dimensions to amplify a first vibration mode of one or more notes in a frequency range of between 500 Hz and 3.5 kHz.

Particular embodiments of the acoustic radiating membrane are defined in the dependent claims 2 to 17.

An advantage of the acoustic radiating membrane lies in the fact that the central portion is made in the form of a piston, according to the principle of a loud speaker, so as to ensure an increase in amplitude of vibration particular over the frequency band from 500 Hz to 3.5 kHz. With such a complex geometrical shape of the acoustic membrane made of a determined material and of a general thickness defined with in-plane dimensions comparable to the in-plane dimensions of a watch case or crystal, the acoustic response of the membrane is relatively uniform in this frequency range.

The reason for this advantage is that, for this type of construction, the fundamental vibration mode frequency, which is the most acoustically efficient, may be reduced by around 1,000 Hz, without significantly reducing the acoustically inefficient excited mode frequency. Thus, the membrane responds, throughout the entire frequency band concerned (500-3,500 Hz), according to the spatial deformation of its own fundamental mode, which maximises acoustic radiation.

Advantageously, the deformation of the central portion of the membrane corresponding to the first vibration mode is different from a standard flat-bottomed membrane. The movement normal to the central portion of the membrane is identical over the entire surface of the central portion. This substantially increases acoustic radiation and guarantees amplification of a set of notes generated in a musical or striking watch. The first vibration mode of each note generated lies therefore at least within the range of frequencies between 500 Hz and 3.5 kHz. A second natural vibration mode is also within the frequency range between 500 Hz and 3.5 kHz. Further, the peak width of at least the first vibration mode is greater than for a standard flat-bottomed membrane.

Advantageously, the membrane can be made of amorphous metal or metallic glass, or also of gold or platinum, or even of brass, titanium, aluminium or another material with a similar density, Young's modulus and elastic limit. With such a membrane, extension of the sound bandwidth can be combined with very low internal damping, which allows for very good acoustic performance.

BRIEF DESCRIPTION OF THE DRAWINGS

The objects, advantages and features of the acoustic radiating membrane for a musical watch or striking watch will appear more clearly in the following description given on the basis of at least one non-limiting embodiment, illustrated by the drawings, in which.

DETAILED DESCRIPTION OF THE INVENTION

In the following description, reference will be made to the configuration of an acoustic radiating membrane, to equip, in particular, a musical watch, or a striking watch. The acoustic radiating membrane is created in a complex form to increase the vibration amplitude of the different notes generated in a watch case. The membrane is dimensioned so as to amplify, in particular, the first vibration mode, or even a second vibration mode in a frequency band from 500 Hz to 3.5 kHz.

Figure 1A:
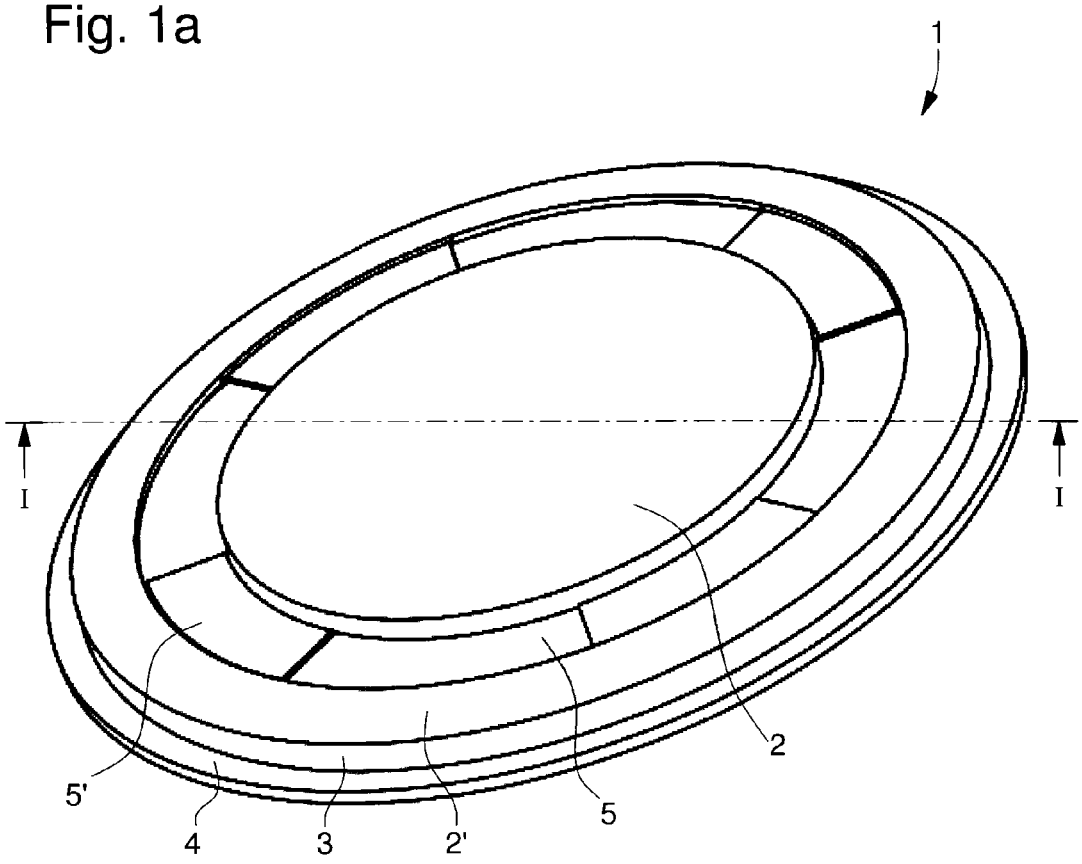
FIGS. 1*a* and 1*b* show a simplified, three-dimensional view and a diametrical cross-section along the line I-I of FIG. 1*a* of an embodiment of the acoustic radiating membrane according to the invention.
Figure 1B:
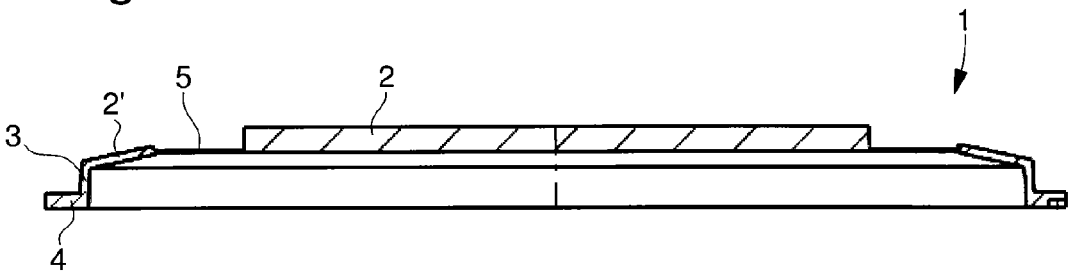

FIGS. 1*a* and 1*b* show an embodiment of the acoustic radiating membrane 1, which may equip a musical watch or a striking watch. Depending on the shape of the watch case, the acoustic radiating membrane 1 may, when seen from above, have a generally rectangular, or polygonal, or preferably circular shape as shown in FIG. 1*a*.

Membrane 1 is configured, for example, in a dome shape with an active central portion 2, 2', 5, defining a dome base, a cylindrical or even slightly conical lateral wall 3, and a peripheral edge portion 4. The central active portion is composed of a central base 2 connected via connecting elements 5 to a peripheral ring 2', which may be concentric to the central base. These connecting elements are in the form of strips and are defined as sectors 5. Sectors 5 are preferably circular or angular sectors starting from the circular periphery of the base and attached to the inner edge portion of the ring. Apertures or openings 5' may be provided between each angular sector 5.

Angular sectors 5 may be regularly distributed at the periphery of the central base 2, which is in the form of a disc, and may have the same dimensions. The general shape of openings 5' are equivalent at each angular sector. The angle of each sector 5 determined from the centre of membrane 1 may be identical to the angle described by each opening 5'. Thus, 4 angular sectors and 4 openings may be provided, each defined at an angle of 45°. However, the angle of each sector may also be different from the angle of each opening.

The peripheral ring 2', which is disposed between the various sectors 5 and an edge of the lateral wall 3, is a circular ring according to FIG. 1*a*. This peripheral ring 2' may be configured as a conical portion with a relatively large opening angle with respect to the central axis of the membrane, for example of around 80°. The peripheral ring is configured to extend towards the exterior of the dome.

It is to be noted that the central base 2 may also be of rectangular shape like the peripheral ring. In that case, at least 4 connecting elements 5, such as connecting sectors, are provided on each side of the rectangular base. It is also possible to devise this central portion with first and second connecting sectors respectively linked to central base 2 and to peripheral ring 2'. The first and second sectors are alternated over the entire periphery of the central base, but the first sectors have a different thickness from the second sectors. In that case, no opening 5' is provided between central base 2 and peripheral ring 2'.

It is also to be noted that instead of a peripheral edge portion 4, an edge portion in the form of several peripheral portions distributed over the periphery of lateral wall 3 may be provided to secure the membrane inside a watch case.

The acoustic radiating membrane 1 with all the elements of which it is composed, may be formed in one piece of the same material, which may be metallic. This material may be amorphous metal or metallic glass in the example described and with reference to FIGS. 2 and 3 explained hereafter. However, this membrane may be made of another material, such as gold, or platinum, or even brass, titanium, aluminium for example with a similar density, Young's modulus and elastic limit.

The membrane may also be made by combining two different materials, by soldering, brazing, driving in or coating. According to a non-limiting version, central portion 2 is made of a material M1 whereas the peripheral ring is made of a second material M2 different from M1. According to a second non-limiting version, central portion 2 is made of a material M1 whereas connecting elements 5 are made of a second material M2 different from M1. According to a third non-limiting version, the membrane is made of material M1, whereas the surface coating is formed by material M2. This coating has a different thickness for central portion 2, peripheral ring 2' and connecting elements 5 and may have a non-homogeneous thickness.

The acoustic membrane 1 can be mounted in a watch case (not shown) with its peripheral edge portion 4, which is clamped in a conventional manner between the back cover and the middle part of the watch case with a sealing gasket. After mounting the membrane in the watch case, the piston-shaped central portion has no contact with the other parts of the watch and can therefore vibrate freely. The central portion and in particular central base 2, is arranged in proximity to, but has no contact with the back cover of the watch case. According to FIGS. 1*a* and 1*b*, which show the membrane in bottom views, central base 2 and angular sectors 5 are planar in shape and disposed on the back cover side of the watch case via conical peripheral ring 2' connected to lateral wall 3.

The central portion may, starting from its connection to lateral wall 3 via peripheral ring 2', have a diameter of more than 15 mm and preferably between 20 and 40 mm. This diameter may be substantially equivalent to that of the watch crystal (not shown), given that peripheral edge portion 4 can be clamped between a peripheral support member of the back cover of the watch case and a circular internal rim of the case middle. Central base 2 may have a diameter of between 60% and 70% of the diameter of the complete central portion. The central base may have a diameter of between 10 and 27 mm according to the respective diameter of the entire central portion, whereas the peripheral ring may have an inner edge portion having a diameter of 13 mm where the diameter of the central portion is 15 mm or a diameter of 34 mm where the diameter of the central portion is 40 mm.

The thickness of disc-shaped central base 2 may be identical at every point and greater than the thickness of peripheral ring 2'. Angular sectors 5 have an identical thickness at every point which is less than the thickness of the peripheral ring. The thickness of each angular sector is much smaller than the thickness of the central base, which defines a central mass. The thickness of each sector may be selected to be between 50 and 100 μm, whereas the thickness of peripheral ring 2' may be greater than 100 μm and less than 1 mm. The thickness of central base 2 may be at least twice the thickness of the peripheral ring.

The central piston-shaped portion may thus be sized according to the material of which it is formed so as to amplify vibration over the frequency band from 500 Hz to 3.5 kHz. The acoustic response of the membrane is thus relatively uniform in this frequency bandwidth. As the membrane is mounted in a striking or musical watch, the first vibration mode of each note generated is therefore at least within the range of frequencies from 500 Hz to 3.5 kHz.

Figure 2:
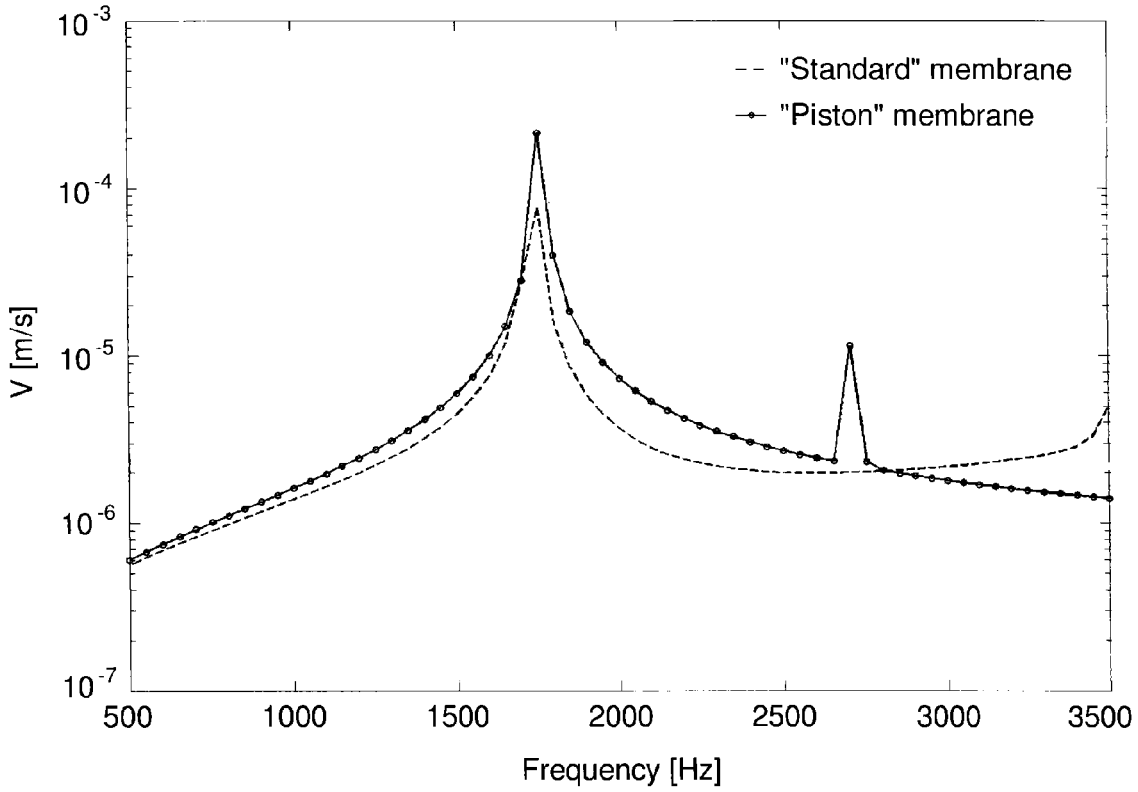
FIG. 2 shows a graph of the integrated frequency response, over the entire volume of the membrane, of the amplitude of velocity normal to the membrane for a standard metallic glass membrane and a metallic glass membrane according to the embodiment of FIGS. 1*a* and 1*b*.
Figure 3:
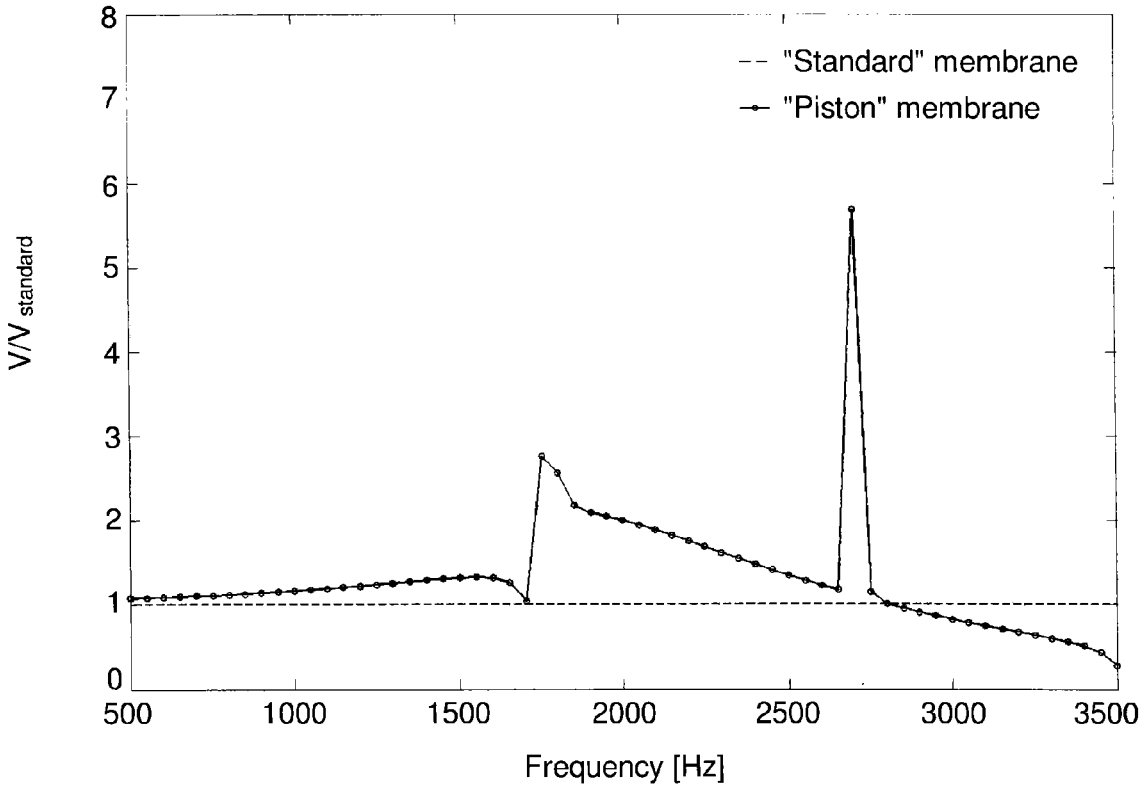
FIG. 3 shows a graph of the ratio between the frequency responses shown in FIG. 2 of the membrane according to the invention and of a standard membrane.

To clearly show the advantage of making an acoustic radiating membrane having a piston-shaped central portion according to the principle of a loudspeaker, reference may be made to the graphs of FIGS. 2 and 3. FIG. 2 shows a graph of the integrated frequency response, over the entire volume of the membrane, of the amplitude of velocity normal to the membrane for a standard metallic glass membrane and a metallic glass membrane according to the invention. This quantity is mathematically defined as $R(f)=\int_{vol}|v_z(x, y, z, f)|dx\,dy\,dz$. FIG. 3 shows a graph of the ratio between the frequency responses of the membrane according to the invention and of the standard membrane.

With regard to the graphs shown in FIGS. 2 and 3, it is noted that the width of the peak of the first vibration mode between 1.5 kHz and 2 kHz, for example at 1.75 kHz, is greater and of larger amplitude than for a peak of the first vibration mode of a standard membrane. Further, there is also provided another peak of a second vibration mode between 2.5 kHz and 3 kHz for the membrane according to the invention. Such an acoustic radiating membrane, which is made with an active central portion of complex shape, makes it possible to increase the vibration amplitude in a frequency range of between 500 Hz and 3.5 kHz. This advantageously differs from a standard membrane whose central portion is simply flat.

It is also to be noted that a piston-shaped membrane according to the invention makes it possible to obtain an identical motion over the entire surface and thus to guarantee a more effective radiating effect than any prior art membrane.

From the description that has just been given, several variants of the acoustic radiating membrane for a musical watch or striking watch can be devised by those skilled in the art without departing from the scope of the invention defined by the claims. The sectors connecting the central base to the peripheral ring may have a variable thickness, but which is smaller than the thickness of the ring and of the central base.

What is claimed is:

1. An acoustic radiating membrane for a musical watch or a striking watch, the membrane comprising:

a central active portion and an edge portion to retain the membrane in a watch case, wherein the central portion includes a central base connected by connecting elements to a peripheral ring, the central base, the connecting elements and the peripheral ring being of determined dimensions to amplify a first vibration mode of one or more notes in a frequency range of between 500 Hz and 3.5 kHz, the central base is of generally circular shape, and the connecting elements are angular sectors arranged on a periphery of the central base, and openings are provided between each angular sector in a number equal to the angular sectors.

2. The membrane according to claim 1, wherein the central base is in the form of a flat disc.

3. The membrane according to claim 1, wherein a diameter of the central base is comprised between 60% and 70% of a diameter of the whole central portion.

4. The membrane according to claim 1, wherein the peripheral ring is of generally circular shape and is concentric to the central base.

5. The membrane according to claim 4, the membrane including a general dome shape with the central portion defining a base and being connected to a lateral wall via the peripheral ring, and with a peripheral edge portion extending from the lateral wall, wherein the peripheral ring is configured as a conical portion with an opening angle defined with respect to a central axis of the membrane.

6. The membrane according to claim 1, wherein the angular sectors have identical dimensions and are regularly arranged over the periphery of the central base.

7. Membrane according to claim 1, wherein the general shapes of the openings are equivalent to each angular sector.

8. The membrane according to claim 1, wherein a thickness of the angular sectors is identical at every point, the thickness of the angular sectors is smaller than a thickness of the peripheral ring, and the thickness of the peripheral ring is smaller than a thickness of the central base.

9. The membrane according to claim 1, wherein the central base is connected to the peripheral ring by 4 angular sectors, an angle of each angular sector determined from a center of the membrane being 45°.

10. The membrane according to claim 1, wherein the connecting elements are made of a first material different from a second material of which the central base and the peripheral ring are made.

11. The membrane according to claim 1, wherein the central base and the peripheral ring are made of two different materials.

12. The membrane according to claim 1, wherein the membrane is made with a surface coating, a thickness of the coating being non-homogeneous and different in correspondence with the central base, the peripheral ring and the connecting elements.

13. The membrane according to claim 1, the membrane including a general dome shape with the central portion defining a base and being connected to a lateral wall via the peripheral ring, and with a peripheral edge portion extending from the lateral wall, wherein the central base, the connecting elements, the peripheral ring, the lateral wall and the peripheral edge portion are formed in one piece made of a same material, which is amorphous metal or metallic glass.

14. The membrane according to claim 1, the membrane including a general dome shape with the central portion defining a base and being connected to a lateral wall via the peripheral ring, and with a peripheral edge portion extending from the lateral wall, wherein the central base, the connecting elements, the peripheral ring, the lateral wall and the peripheral edge portion are formed in one piece made of a same material, which is gold or platinum or brass or titanium or aluminum.

15. An acoustic radiating membrane for a musical watch or a striking watch, the membrane comprising:

a central active portion and an edge portion to retain the membrane in a watch case, wherein the central portion includes a central base connected by connecting elements to a peripheral ring, the central base, the connecting elements and the peripheral ring being of determined dimensions to amplify a first vibration mode of one or more notes in a frequency range of between 500 Hz and 3.5 kHz, the central base is of generally circular shape, and the connecting elements are first and second angular connecting sectors respectively connected to the central base and to the peripheral ring, the first and second angular sectors are arranged alternately over an entire periphery of the central base, and the first angular sectors include a different thickness from the second angular sectors.

16. The membrane according to claim 15, wherein the connecting elements are made of a first material different from a second material of which the central base and the peripheral ring are made.

17. The membrane according to claim 15, wherein the central base and the peripheral ring are made of two different materials.

18. The membrane according to claim 15, wherein the membrane is made with a surface coating, a thickness of the coating being non-homogeneous and different in correspondence with the central base, the peripheral ring and the connecting elements.

19. The membrane according to claim 15, wherein the central base is in the form of a flat disc.

20. The membrane according to claim 15, wherein a diameter of the central base is comprised between 60% and 70% of a diameter of the whole central portion.

* * * * *